United States Patent [19]

Calabrese

[11] Patent Number: 4,607,784

[45] Date of Patent: Aug. 26, 1986

[54] FOLDABLE COMBINATION SEAT AND PORTABLE CONTAINER

[76] Inventor: Thomas A. Calabrese, 149 Western Ave., Cambridge, Mass. 02139

[21] Appl. No.: 766,350

[22] Filed: Aug. 16, 1985

[51] Int. Cl.[4] ..... B65D 5/48; B65D 5/46; A47C 7/62

[52] U.S. Cl. ..... 229/27; 190/116; 229/45 R; 229/52 A; 229/115; 297/118; 297/193

[58] Field of Search ..... 229/22, 52 B, 27, 44 R, 229/45 R, 52 A; 297/118, 193; 190/116

[56] References Cited

U.S. PATENT DOCUMENTS

| | | | |
|---|---|---|---|
| 593,489 | 11/1897 | Noland | 229/52 A |
| 763,142 | 6/1904 | Bisler | 229/46 |
| 1,996,997 | 4/1935 | Inman | 229/22 |
| 2,312,598 | 3/1943 | Sprague | 229/52 B |
| 3,185,378 | 5/1965 | Rosenburg, Jr. | 229/22 |
| 3,428,235 | 2/1969 | Randazzo | 229/22 |
| 3,550,834 | 12/1970 | McCall | 229/22 |
| 3,730,418 | 5/1973 | Spencer | 229/22 |
| 4,179,061 | 12/1979 | Gilbert | 229/27 |

FOREIGN PATENT DOCUMENTS

| | | | |
|---|---|---|---|
| 624562 | 7/1961 | Canada | 229/52 A |
| 479711 | 4/1953 | Italy | 229/22 |
| 1133776 | 11/1968 | United Kingdom | 229/44 R |

*Primary Examiner*—William Price
*Assistant Examiner*—Gary E. Elkins
*Attorney, Agent, or Firm*—Donald W. Meeker

[57] ABSTRACT

A cross-shaped rigid sheet is creased and folded in rectangular sections. An elongated rectangle is subdivided into four small rectangles: three wall-forming rectangles and one interior-support-forming rectangle. Interconnection by tabs and slots forms a box structure of triangular cross-section. End-forming rectangles are creased to form a triangular end with two triangular tabs. The triangular tabs are inserted in wall slots to close both ends. An interior support wall stretches from an apex of the triangle to the middle of an opposite wall. Aligned hand slots through two exterior walls and the intermediate interior support form a handle means. Alternately an external carrying handle may be attached to the box structure. A rigid support strip with a handle recess may be used for lifting reinforcement. Holes in the triangular tabs make them easier to pull out of the slots. Protrusions from the walls through the triangular tab holes serve as a locking means. Alternatively, or additionally, slots in the triangular tabs interlock with the slots in the box to lock in the tabs. An attached strap facilitates carrying the box or attaching the box to an external carrying or storage means. Holes in the walls or ends permit use as a pet carrying box.

14 Claims, 6 Drawing Figures

FOLDABLE COMBINATION SEAT AND PORTABLE CONTAINER

BACKGROUND OF THE INVENTION

1. Technical Field

The present invention relates to folding support structures and in particular to a convertible seat/container formed from an integral piece of material and having an interior support and slot-formed or attached handle.

2. Background Art

On any outing whether it be a sporting event, picnic, shopping or any other occasion involving travel and transportation of goods, it is often desirable to sit down, whether for viewing an event, eating or just waiting for a ride. Most carrying containers do not provide a means for sitting because of inappropriate shape or structure.

Rigid containers which might be usable for sitting are generally heavy and bulky to store. Folding seating which is strong yet light-weight generally has no provision for carrying or storing objects.

The few portable seat/containers which might be available are approximately rectangular in cross-section or have a single wall structure with no internal supports, so that the strength of the other portable seat/-containers is limited and therefore of questionable value.

DISCLOSURE OF INVENTION

A foldable rigid structure combining a capacity to carry a substantial number of heavy objects, such as a quantity of beverage cans and a capacity to support considerable weight externally, such as a seated 250 pound person, serves a very useful purpose for picnics, sporting events, traveling, shopping or any other activity involving both transporting goods and sitting.

A sturdy cardboard blank is creased and provided with tabs and slots to form a rigid light-weight structure by interlocking the elements. When empty and not in use as a seat the rectangular elements of the structure may be folded over one another to form a flat compact unit which is easy to transport or store.

Folding and interlocking the rectangular elements into a box structure having a triangular cross-section with an additional interior support forming a pair of triangular sub-boxes within the primary triangular container and further interlocking closed ends create a very strong rigid structure to support or transport considerable weight. A built-in cut-out handle formed of aligned slots in adjacent folded rectangular elements creates a convenient and strong handle which may be further reinforced by an inserted rigid element for transporting extra heavy loads. An external handle may be attached to the slots or attached directly onto the box structure. External straps applied to the ends or sides of the box structure provide additional carrying or tie down storage capability. Locking means on the triangular tabs insures that the ends of the box structure will remain closed.

A light-weight rigid structure which is both portable and foldable, provides a great many uses with the invention constructed in various sizes and with various materials and coverings, including internal and external printing. Possible uses include: a combination seat and food- or drink-carrying case for picnics, sporting events and the like; a shopping container carried to the store flat or with empty cans or bottles and filled with goods at the store to carry home, while doubling as a seat to rest or wait for a bus or ride; a construction or on-site design stool with plans carried and stored inside; a take-out box for food with a menu printed inside or outside; a color-coded storage and carrying compartment; a colorful display and carry-home container for products; furniture seats, pedestals or modular components or supports with home items, such as magazines stored inside; a hand bag; a pet transporter with breathing holes in the container; a carrier for skiis or other sporting goods, particularly useful on airlines; and the invention could be sold from a dispensing machine.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
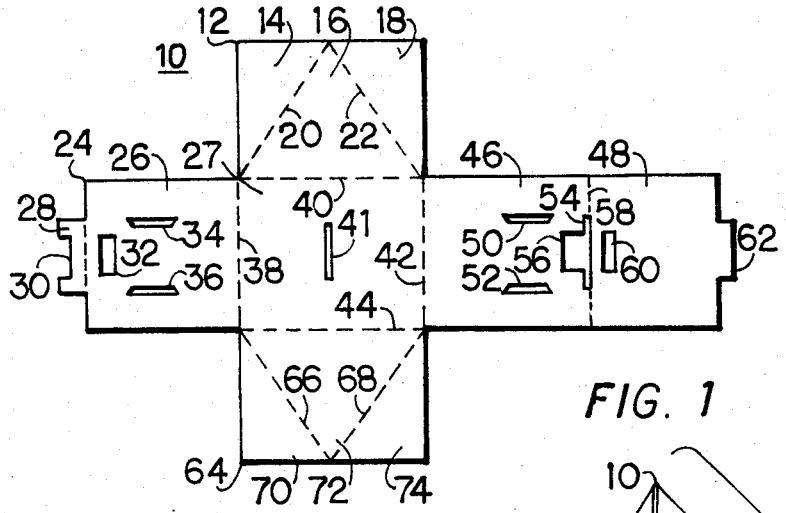
FIG. 1 is a plan view of the blank used to fabricate the invention laid out flat.

In FIG. 1 a flat sheet of rigid light-weight material is laid out as the blank for the invention 10, shaped like a cross having an elongated rectangular portion 24 and extending therefrom, approximately at a quarter point, two smaller rectangular end-forming sections 12 and 64. The elongated rectangular portion 24 is provided with three transverse crease lines 38, 42 and 58 (dashed lines) which divide the elongated rectangular portion into four rectangles: three interconnected wall-forming rectangles 26, 27 and 46, and an interiorsupport-forming rectangle 48 at one end. The small rectangular end-forming sections 12 and 64 extend one from each of two sides of the second wall-forming rectangle 27, foldably connected thereto by crease lines 40 and 44 respectively.

Each end-forming rectangle is provided with a pair of crease lines, 20 and 22 on rectangle 12 and 66 and 68 on rectangle 64 (dashed lines), from the middle of the outer edge to a point where the side edge contacts connects with the elongated rectangular portion. When the end-forming rectangles are folded, each is formed into a triangular end 16 and 72 and a pair of triangular tabs 14 and 18 in one and 70 and 74 in the other.

Figure 2:
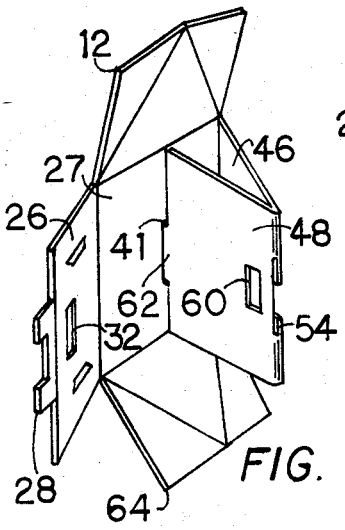
FIG. 2 is a perspective view of the invention partially assembled into a three dimensional structure with the interior structural component in place.

In FIG. 2 an end tab 62 from the interior-support-forming rectangle 48 is inserted into a central transverse slot 41 formed in the second wall-forming rectangle 27 to create half of the box structure for the combination seat/container. The entire box structure is completed by inserting a U-shaped or other shaped tab 28 from the first wall-forming rectangle 26 into a slot 54 between the third wall-forming rectangle 46 and the interior-support 48. The U-shape mates with the hand slots when appropriate.

Figure 3:
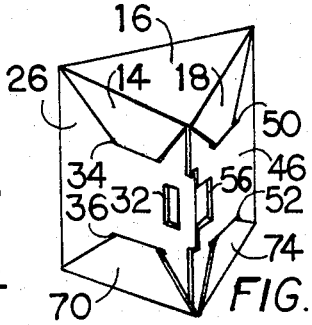
FIG. 3 is a perspective view of the invention fully assembled and positioned upright for use as a seat or stand.

In FIG. 3 the box structure is shown completed with all of the triangular end tabs inserted in the mating slots: tab 14 in slot 34, tab 18 in slot 50, tab 70 in slot 36 and tab 74 in slot 52, thereby closing the two ends of the triangular box with triangular ends 16 and 72 to form an enclosed container with structural integrity for dual use as a seat.

Slots sufficiently large to receive a hand therein are formed in the three rectangles which meet to form one apex of the triangle in the triangular box: hand slot 32 in the first wall-forming rectangle 26, hand slot 60 in the interior-support rectangle 48 and hand slot 56 third wall-forming rectangle 46. A user's hand may be inserted through all three slots simultaneously for a convenient and strong handle means to carry the closed structure.

Figure 4:
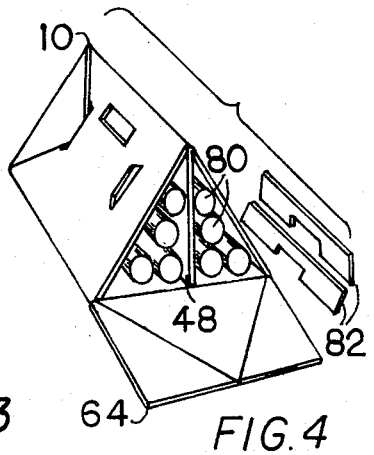
FIG. 4 is a perspective view of the invention positioned for carrying items, showing cans stored inside with two inserts for strengthening the top edge of the invention for carrying heavy loads.

In FIG. 4 the box structure of the invention 10, with the interior support 48 inserted in place, is loaded with goods, in this instance with beverage cans 80. For a heavy load such as this, if the cans are full, elongated support strips 82 of rigid material may be inserted into the apex at the handle location for additional support at the critical load bearing point where the container is lifted. In this configuration for a given size container, an entire case if twenty-four twelve-ounce cans may be transported stacked three deep. Recesses in the support strips 82 mate with the hand slots.

Figure 5:
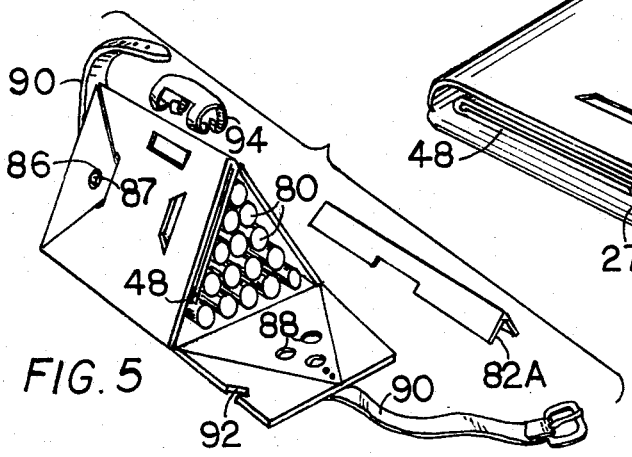
FIG. 5 is a perspective view of the invention positioned for carrying items, and with the interior support element positioned against one side to permit a larger storage capacity.

In FIG. 5 the interior support 48 is bent over to one side of the triangular box structure to enable the box structure to be packed tightly with thirty cans 80. A V-shaped support strip 82A with recesses may be inserted in this situation. The load itself in this case provides internal structural support because of the tight packing. The triangular tabs may be provided with holes 86 to assist in removing the tabs from the slots. An additional protrusion 87 which may be retractable extends from the container wall to engage the tab hole 86 for locking the tab closed. Straps 90, secured to the ends or sides or bottom of the box structure either permanently or removably, provide ease of handling of the box structure in transporting it or securing it to something else. The ends of the straps are removably interconnected, by a buckle or other means, to form a loop for lifting or tieing down the box structure . Additionally providing breathing holes 88 in the wall or end components enables the user to carry a pet in the container. A slot 92 in the triangular tab may be provided as a locking means to insure that the tab remains in the slot by hooking the tab into the slot. An external handle 94 may be attached by hooking to the existing handle slots or attached directly to the box structure by riveting or other conventional means.

Figure 6:
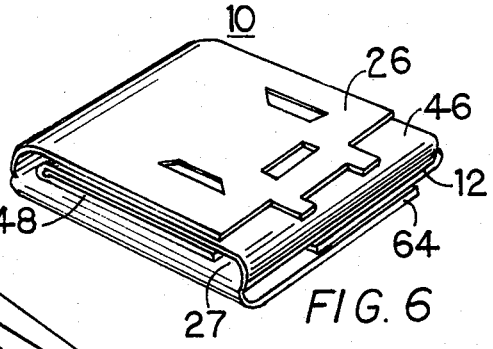
FIG. 6 is a perspective view of the invention folded flat for storage or transporting in an empty mode.

In FIG. 6 the invention is shown folded down flat with the first wall-forming rectangle 26 on top sandwiching the third wall-forming rectangle 46 and the interior-support-forming rectangle 48 between the first and second wall-forming rectangles 26 and 27. Folded under the second wall-forming rectangle 27 are the two end-forming rectangles 12 and 64. Folded flat, the invention is easily stored or carried.

Although it is preferred to construct the invention from a stiff cardboard material, it is understood that other materials may be used as appropriate for various particular applications: thin cardboard for take-out foods, stiff leather for a handbag, plastic, metal, covered wire frame or any other as necessary or desired. The material may be imprinted, painted, coated or colored or provided with other advertising means as desired for interesting visual effects, advertising and information.

It is understood that the preceding description is given merely by way of illustration and not in limitation of the invention and that various modifications may be made thereto without departing from the spirit of the invention as claimed.

I claim:

1. A foldable combination seat and portable container, easily folded flat and assembled, constructed from a cross-shaped flat sheet of rigid material formed into an elongated rectangular portion and, foldably extending therefrom along a foldline extending from approximately a quarter to one half the length of the sheet, two small rectangular end-forming sections, wherein the elongated rectangular portion is provided with three transverse creases along its length, dividing the elongated rectangular portion into four rectangles comprising three interconnected wall-forming rectangles and an interior-support-forming rectangle at one end, each of which rectangles may be bent relative to the others and interconnected by tabs and slots to form a rigid three-dimensional box structure of triangular cross-section having the interior support forming rectangle connected between an apex of the triangle to a center of a wall opposite the apex, and the two small rectangular end-forming sections are each creased from a center of an outer edge to each of two side edges at a point where each side edge connects with the elongated rectangular portion thereby forming a triangle equal to the triangular cross-section and two foldover triangular tabs, wherein each rectangular end-forming section folds over onto the triangular box structure to form each of two opposing closed ends for the triangular box structure with each triangular tab inserted in a mating slot in a all of the triangular box structure.

2. The invention of claim 1 wherein the second wall-forming rectangles is provided with a central transverse slot and the interior-support-forming rectangle is provided with a tab extending from an outer edge, which tab is inserted within the central transverse slot to form an interior support.

3. The invention of claim 1 wherein one of the end wall-forming rectangles is provided on an outer edge centrally with a tab extension and interiorly of the tab extension with a slot and wherein the third wall-forming rectangle, which mates with the end wall-forming rectangles upon fabrication of the structure, is provided at a mating edge with a slot to receive the tab extension from the end wall-forming rectangles and the two slots form a handle slot having a length sufficient to serve as a receiving handle for carrying the invention.

4. The invention of claim 3 further comprising at least one elongated strip of rigid material having a central recess corresponding in length to the handle slot length, wherein the elongated strip is inserted within the structure along the intersection of the end wall-forming rectangle and and the third wall-forming rectangle to serve as a reinforcement for carrying heavy loads in the invention.

5. The invention of claim 1 wherein the end-forming rectangles are foldably attached to the second wall-forming rectangle and the creases formed in the end-forming rectangles are each equal in length to the length of an edge of an adjacent wall-forming rectangle.

6. The invention of claim 1 wherein the end wall forming rectangles and the third wall-forming rectangle are each provided with the mating slots adjacent to each side edge to receive the tabs from the end-forming rectangles.

7. The invention of claim 1 further comprising breathing holes through the walls thereby creating a pet carrying means.

8. The invention of claim 1 further comprising an opening through each triangular tab for ease in removing the tabs from the slots.

9. The invention of claim 1 further comprising a locking means between each triangular tab and the three dimensional structure.

10. The invention of claim 1 further comprising a strap means secured to the box structure for ease of handling the box structure.

11. The invention of claim 1 further comprising an external carrying handle attached to the triangular box structure.

12. A foldable combination seat and portable container comprising a cross-shaped flat sheet of rigid material comprising an elongated rectangular portion creased transversely along three lines to form first, second and third wall-forming rectangles and a fourth interior-support-forming rectangle, and extending from the second rectangle, on each of two sides of the second rectangle, a small rectangular end-forming rectangle foldably connected to the second rectangle; wherein the first wall-forming rectangle comprises a tab extending from an outer end, a handle-forming slot in the first rectangle adjacent to the tab and a tab-receiving slot in the first rectangle adjacent to each of two lateral sides; wherein the second wall-forming rectangle comprises a centrally positioned transverse slot; wherein the third wall-forming rectangle comprises a tab-receiving slit between the third rectangle and the fourth rectangle and a handle-forming slot adjacent to the slit, and adjacent to each of two lateral sides, a tab-receiving slot; wherein the fourth interior-support-forming rectangle comprises an end tab; wherein each end-forming rectangle comprises a crease line from a center of an outer end to each of two side edges at a point where the side edges meet the elongated rectangle and one of the crease lines is equal in length to the length of a side of the first rectangle and the other crease line is equal in length to the length of a side of the third rectangle, thereby forming a central triangular end and two side triangular tabs in each end-forming rectangle; wherein the sheet of rigid material is reversibly folded to form the combination seat and hand-carried container structure by inserting the interior-support-forming tab in the second rectangle slot and inserting the first rectangle tab in the tab-receiving slit of the third rectangle and inserting each triangular tab in a tab-receiving slot on the first and third rectangles, thereby forming a rigid box structure of triangular cross-section having an interior support and closed at each end so that objects may be carried therein by inserting a user's hand through the handle-forming slots which are now aligned, or the structure may be placed with an end resting on a horizontal surface and the opposite end used as a seat or stand.

13. The invention of claim 12 further comprising at least one elongated strip of rigid material having a central recess corresponding in length to the handle slot length, wherein the elongated strip is inserted within the structure along an apex of the triangular structure formed by the first and third rectangles so that the recess aligns with the handle-forming slots.

14. The invention of claim 12 wherein the tabs are removed from the slots and the rectangles folded over one another for flat compact storage or transport.

* * * * *